United States Patent [19]

Suga et al.

[11] 4,010,034

[45] Mar. 1, 1977

[54] METHOD FOR ADJUSTING THE BROMIDE ION CONCENTRATION IN A PHOTOGRAPHIC PROCESSING SOLUTION

[75] Inventors: Tsuneo Suga, Tokyo; Masaru Kanbe; Shinobu Korematsu, both of Hachioji; Toshiaki Takahashi, Musashimurayama; Ken-ichi Kishi, Machida, all of Japan

[73] Assignee: Konishiroku Photo Industry Co., Ltd., Tokyo, Japan

[22] Filed: July 8, 1975

[21] Appl. No.: 594,128

Related U.S. Application Data

[63] Continuation of Ser. No. 398,187, Sept. 17, 1973, abandoned.

[30] Foreign Application Priority Data

Sept. 22, 1972 Japan ..... 47-94600

[52] U.S. Cl. ..... 96/60 BF; 96/61 R; 96/66 R

[51] Int. Cl.[2] ..... G03C 5/32; G03C 5/38; G03C 5/30

[58] Field of Search ..... 96/50 A, 50 R, 60 BF, 96/66 R, 61 R, 66 T

[56] References Cited

UNITED STATES PATENTS 1,933,804 11/1933 Hickman ..... 96/50 A

*Primary Examiner*—Mary F. Kelley
*Attorney, Agent, or Firm*—Bierman & Bierman; Jordan B. Bierman; Linda G. Bierman

[57] ABSTRACT

An improved method for adjusting bromide ion concentration in a photographic processing solution is disclosed in which the processing solution is contacted with particles of an insoluble bismuth compound.

7 Claims, No Drawings

METHOD FOR ADJUSTING THE BROMIDE ION CONCENTRATION IN A PHOTOGRAPHIC PROCESSING SOLUTION

This application is a continuation of application Ser. No. 398,187, filed Sept. 17, 1973, now abandoned which claims the priority of Japanese Application No. 94600/72, filed Sept. 22, 1972.

This invention relates to a method for adjusting the bromide ion concentration in a photographic processing liquid.

Various photographic processing liquids are used for development of light-exposed silver halide photosensitive materials. In these photographic processing liquids, optimum compositions are selected depending on the kinds of silver halide photosensitive materials to be processed. For instance, in the case of a developer, an optimum developing chemical is selected depending on the kind of a photosensitive material, e.g., a photosensitive material for color photography, a photosensitive material for ordinary monochromatic photography, a photosensitive material for lithography, or a photosensitive material for Roentgen photography, and a developer having an optimum chemical concentration is employed. Such developer exhibits a most desired developing activity when the concentration of each chemical is maintained within a specific range. However, while the developer is used for development of the photosensitive material, parts of chemicals are consumed and simultaneously chemicals eluted from the photosensitive materials are incorporated into the developer, with the result that the composition of the liquid developer is changed and its developing activity is reduced. For instance, the amount of a developing chemical in a developer is gradually decreased because it is oxidized when it reduces a silver halide, whereas the concentration of a halide ion is increased in the developer because it is eluted into the developer as a result of reduction of the silver halide. In order to reactivate a photographic processing liquid, for reuse, which has been used for processing of a photosensitive material and whose processing activity has been lowered, it is generally conducted to supply a replenisher into such exhausted solution after a predetermined amount of the photosensitive material has been processed. However, according to such method comprising adding a replenisher, it is impossible to reduce the concentration of a component whose amount has been increased during the processing, though it is possible to compensate the lost component. Therefore, the undesired component, the amount of which is increased by repetition of reactivation of the processing solution by supply of a replenisher, is accumulated in the processing solution, and finally, the processing solution is in such a state that its processing activity cannot be restored by supply of a fresh treating liquid, that is, a replenisher. At this point the processing solution is discarded and the entire of the processing solution is replaced by a replenisher. When a replenisher is supplied to the used processing solution, in order to maintain the amount of the solution in a processing tank at a constant level, a part of the used solution is generally discarded by overflowing or the like so that the amount discarded of the used solution is equal to the amount of the supplied replenisher. Indeed, the increased concentration of the undesired component can be reduced to some extent when a part of the used treating liquid is thus discarded. However, in order to reduce the concentration of the undesired component to a desired concentration, it is necessary to discard a very large amount of the used processing solution.

In the case of a developer, for instance, the halogen ion concentration in the treating liquid increases as the development treatment is repeated. More specifically, concentrations of chloride and bromide ions increase in a developer for photosensitive material comprising as a main component a silver chloro-bromide emulsion, such as a lithographic film, a microfilm or an ordinary printing paper for monochromatic photography. In the case of developer for a photosensitive material comprising as a main component a silver iodo-bromide emulsion, such as a Roentgen film, a color film or an ordinary monochromatic film, the iodide ion once released in the solution is replaced by the bromide ion of silver bromide and hence, only the concentration of the bromide ion increases. Among halide ions, the bromide ion gives a great influence to the processing activity of the developer. Namely, the increase of the bromide ion concentraion in the developer results in extreme reduction of the developing rate. Concentrations of chloride ion and other ions increase as well as the bromide ion, but none of them has any influences on the processing activity of the developer even when their concentrations increase. Accordingly, such ions bring about no trouble, but the activity of the developer is greatly influenced adversely by increase of the bromide ion concentraion. Especially in the case of a lithographic developer for use in development of lithographic films, the development rate is greatly reduced by increase of the bromide ion concentration and the influence of the bromide ion concentration on the treating activity of the developer is a serious problem.

In an automatic processing machine in which a large amount of a photosensitive materials is developed continuously at a high speed, it is necessary to conduct the development processing always under stable conditions and to maintain such developing activity that when photosensitive materials exposed under the same condition are developed, the same photographic characteristics can be attained in each developed photosensitive material. For this reason, it is generally conducted to reactivate a developer, the activity of which has been reduced by repetition of the development treatment, by supplying a suitable amount of a fresh developer appropriately. However, even if a part of the used developer is discarded by overflowing or the like, it is very difficult to inhibit the increase of the bromide ion concentration which has a serious influence on the development rate. Accordingly, in order to restore the developing activity of the used liquid developer for reuse, it is indispensably necessary to adjust the increasing concentration of the bromide ion having a bad influence on the developing effect to reduce it to a predetermined low level, while supplying a component necessary for development so as to compensate the loss of said component.

It has been considered actually impossible to reduce the increased concentration of the bromide ion in photographic processing solution, especially a developer, and therefore, a developer, the activity of which has been lowered, is entirely discarded or it is overflown and discarded in a large quantity when a fresh developer is supplied. In each case, the developer is consumed away in abundance, resulting in great economical loss. Further, since various ions are contained in such developer, when it is discarded as it is, it causes environmental pollution. Therefore, the developer to be discarded should be subjected to the pollution-preventive treatment so that the official wastewater disposal regulation will be satisfied. However, huge equipments and vast expenses are required to perform such treatment.

Under such circumstances, development of a method capable of restoring the activity of a exhausted developer so as to use it repeatedly while reducing the amount discarded of the exhausted developer as much as possible has been greatly demanded in the art. As mentioned above, in order to restore the developing activity of a exhausted developer without discarding it, it is necessary not only to supply a component necessary for development to the exhausted developer to compensate the loss by repetition of the development processing, but, also to reduce the concentration of the bromide ion acting as an undesired component having a bad influence on the developing effect, to a predetermined low level. The lowering of the bromide ion concentration cannot be accomplished without removal of the bromide ion. Accordingly, removal of the bromide ion with use of an ion-exchange resin was tried, but the developer contains various anions in addition to the bromide ion and according to the method using an ion-exchange resin, it is quite impossible to remove selectively the bromide ion having a bad influence on the developing activity while leaving other anions in the developer. More specifically, when an ion-exchange resin is used for removal of the bromide ion, components necessary for development represented by developing main chemicals such as hydroquinone and metol are simultaneously removed in large quantities. Accordingly, although the bromide ion concentration can be reduced by the use of an ion-exchange resin, in order to restore the developing activity of the developer sufficiently, it is necessary to supply developing chemicals in large quantities to compensate the lost components resulted from removal with the use of the ion-exchange resin. Therefore, this method is economically disadvantageous and has no practical value.

In photographic processing solution other than a developer, for example, a bleach-fix solution to be used for the treatment of a photosensitive material for color photography, as in the case of a developer, concentrations of bromide and other halide ions increase while these liquids are used for the treatment. In these photographic processing solution influences on the photographic processing activity by increase of the bromide ion concentration are not so serious as in the case of a developer, but when the bromide ion concentration becomes too high, the photographic activity, e.g., the fixing activity, is degraded. Accordingly, in order to regenerate these processing solution, it is preferred that removal of the bromide ion is effected simultaneously with supplement of a fresh liquid.

It is a primary object of this invention to provide a method for adjusting the bromide ion concentration in a photographic processing solution to reduce it to a predetermined level necessary to maintain the processing activity of the processing solution to a desired high level by selectively removing the bromide ion from the exhausted processing solution, whereby the reduced processing activity of the exhausted processing solution which has been used for the processing of a photographic photosensitive material can be restored while reducing the amount discarded of the processing solution to a level as low as possible and the processing solution can be used repeatedly.

We have found that the above object can be attained by contacting a exhausted photographic processing solution with a bismuth compound. More specifically, according to this invention, a photographic processing solution, the processing activity of which has been reduced by increase of the bromide ion concentration, is contacted with a bismuth compound to thereby remove the increased amount of the bromide ion in the state adsorbed on the bismuth compound and restore the treating activity of the photographic processing solution. In short, this invention is directed to a method for adjusting the bromide ion concentration in a photographic processing solution, especially a developer.

Various methods can be adapted for contacting a photographic processing solution with a bismuth compound to be used in this invention.

For instance, there can be mentioned a method comprising throwing particles of a bismuth compound into a photographic processing solution, agitating the mixture to effect the adsorption treatment, and then separating the bismuth compound particles by filtration or the like, and a method comprising charging particles of a bismuth compound in a bag or vessel capable of allowing a photographic processing solution to permeate therethrough sufficiently, passing the photographic processing solution through said bag or vessel under shaking to effect the adsorption treatment, and then taking the bismuth compound particles from the bag or container. Further, there can be employed a method comprising flowing a photographic processing liquid into a long column of a small diameter packed with particles of a bismuth compound from one end thereof, and discharging the photographic processing solution from the other end of the column. In case an automatic developing machine is employed, in view of the operation facility it is preferred that a circulation system comprising a tank of a photographic processing solution and a column of bismuth compound particles connected with said tank is employed.

When a exhausted processing solution is contacted with a bismuth compound according to method such as mentioned above, halide ion, especially the bromide ion, are selectively adsorbed on the bismuth compound and removed from the photographic processing solution to thereby reduce the bromide ion concentration in the solution. This bromide ion-adsorbing activity of the bismuth compound is especially prominent when the pH of the liquid is low. This fact is very important for attaining the object of the invention. More specifically, the pH value of a exhausted photographic processing solution is at most about 10, and therefore, a bismuth compound can fully exhibit the bromide ion-adsorbing activity in such liquid. Further, since the bromide ion-adsorbing activity of the bismuth compound is low at a higher pH value, if the bismuth compound carrying the bromide ion in the state adsorbed thereon is contacted with a liquid having a high pH value, for example, an aqueous solution of sodium hydroxide, the adsorbed bromide ion can be easily desorbed.

Accordingly, in this invention, in contacting a exhausted photographic processing solution with a bismuth compound to remove the bromide ion from the liquid in the state adsorbed on the bismuth compound and adjust the bromide ion concentration in the solution, only by contacting the used bismuth compound with an aqueous solution of an alkali, the bromide ion-adsorbing activity can be easily restored and the bismuth compound can be used repeatedly. It is one of great advantages of this invention that the bromide ion-adsorbing activity of a bismuth compound to be used in this invention can easily be restored and regenerated. It is indispensable that the bismuth compound to be used in this invention should be hardly soluble in a photographic processing liquid. In view of the treating efficiency and regeneration efficiency, it is preferred that the bismuth compound has a large area for contact with a photographic processing solution or a regeneration liquid. Therefore, when the bismuth compound has a coarse form, it is desired that the coarse particles are pulverized into fine particles.

The bismuth compound to be used in this invention has a property of adsorbing halide ions selectively, and among halide ions, the iodide ion is adsorbed most selectively a and the bromide ion-adsorbing activity comes next. As compared with iodide and bromide ions, the chlorine ion is adsorbed at a relatively low rate.

The bismuth compound adsorbs ions other than halide ions, but the adsorbed amounts are extremely small. Accordingly, it can be considered that the bismuth compound has a property of adsorbing selectively halide ions, especially iodide and bromide ions. As pointed above, the iodide ion is hardly present in a exhausted photographic processing solution, and therefore, when the exhausted photographic processing solution is contacted with the bismuth compound, only the bromide ion is selectively adsorbed among ions contained in the exhausted photographic processing solution.

When according to the method of this invention the bromide ion is selectively removed from a exhausted photographic processing solution and the bromide ion concentration is adjusted in the solution, it is made possible to restore the processing activity of the exhausted solution without discarding a large quantity of the processing solution, namely only by discarding such a small amount of the solution as corresponding to the amount of a fresh liquid added to compensate the loss of a chemical component necessary for the photographic treatment. In some cases, since a small amount of the treating liquid is taken out of the tank together with the photosensitive material, it is quite unnecessary to discard even a bit of the processing solution and it is sufficient only to supply a photographic chemical in an amount compensating the loss in the processing process, whereby the photographic processing activity of the liquid is restored and the solution can be used repeatedly. Further, the bismuth compound used for adsorbing and removing the bromide ion can be used repeatedly if it is only contacted with an aqueous solution of an alkali to regenerate its bromide ion-adsorbing activity. Thus, in practising the method of this invention provision of an apparatus of a large unit is unnecessary and the bromide ion concentration in a exhausted photographic processing solution can be adjusted at low costs and with high efficiency. Further, when the method of this invention is combined with the exhausted photographic processing solution regeneration process steps, maintenance and control of photographic processing solution represented by a developer can be attained effectively and stably.

As the bismuth compound to be used in this invention, there can be mentioned, for example, bismuth (III) trioxide ($Bi_2O_3$, $Bi_2O_3.H_2O$, $Bi_2O_3.2H_2O$ and $Bi_2O_3.3H_2O$), bismuth (IV) tetroxide ($Bi_2O_4.2H_2O$), bimuth (V) pentoxide ($Bi_2O_5$ and $Bi_2O_5.H_2O$), bismuth hydroxide $Bi(OH)_3$, etc. Each of these bismuth compounds is insoluble in water and is insoluble in a photographic processing solution.

In view of the operation facility, in this invention it is desired that the bismuth compound is used in the form of particles and the particles size is within a range of from $0.1\mu$ to $50\mu$.

The method of this invention for adjusting the bromide-ion concentration in a photographic processing solution comprises the following three steps. At the first step, the photographic processing solution from which the bromide ion is to be removed is contacted with a bismuth compound such as mentioned above to thereby make the bromide ion adsorbed on the bismuth compound and to reduce the bromide ion concentration in the photographic processing solution. Thus, the bromide ion concentration in the photographic processing solution is adjusted to a desired low level. At the subsequent second step, the bismuth compound used at the first step is separated from the photographic processing solution and contacted with an aqueous solution of sodium hydroxide of a concentration of 0.1 N to 2 N, whereby the bromide ion adsorbed on the bismuth compound is released therefrom and the bromide ion-adsorbing activity is restored in the bismuth compound. The third step is an optional step, and at this step the bismuth compound is washed with water to remove the sticked sodium hydroxide therefrom. By conducting the above steps repeatedly and using a certain amount of the bismuth compound repeatedly, the bromide ion concentration in a large quantity of a photographic processing solution can be adjusted.

In case a bismuth compound having an average particle size of $5\mu$ is employed, at the first step, the equilibrium state is reached in about 3 hours at room temperature.

The time required for regeneration of the bismuth compound at the second step varies depending on the alkali concentration, but it is within 10 hours at room temperature and within 5 hours at 60° C. It is desired that the water washing at the third step is conducted until the pH value of the washing liquid is about 10.

This invention will now be illustrated more detailedly by reference to Examples, but it must be noted that embodiments of this invention are not limited to those shown in these Examples.

EXAMPLE 1

50 g of bismuth hydroxide having an average particle size of $15\mu$ was added to 1 l of a developer for lithographic films containing the bromide ion at a concentration of 0.0235 M, and the mixture was agitated at room temperature for 3 hours. During this agitation treatment, a fixed small amount of the supernatant was sampled at every prescribed interval and the bromide ion concentration in the sampled supernatant was determined to obtain results shown in Table 1. As is seen from the results shown in Table 1, the bromide ion concentration in the solution was gradually reduced.

Table 1

| Time after addition of Bismuth Hydroxide | Bromide Ion Concentration (M) in Developer | Bromide Ion Adsorption Ratio (%) |
|---|---|---|
| 15 minutes | 0.0215 | 9 |
| 30 minutes | 0.0198 | 16 |
| 1 hour | 0.0142 | 40 |
| 2 hours | 0.0122 | 48 |
| 3 hours | 0.0115 | 51 |

The values of the bromide ion adsorption ratio given in the Table were calculated according to the formula:

$$\text{Bromide ion adsorption ratio (\%)} = \frac{(C - C')}{C} \times 100$$

in which C designates the bromide ion concentration before the treatment and C' indicates the bromide ion concentration after the treatment.

The bismuth hydroxide was separated from the so treated developer and was added to 300 cc of a 0.2 N aqueous solution of sodium hydroxide. The mixture was agitated for 5 hours at 60° C., and the bismuth hydroxide was separated from the liquid by filtration and washed with water, whereby the bromide ion-adsorbing activity of the bismuth hydroxide was completely restored.

EXAMPLE 2

50 g of bismuth trioxide having an average particle size of 10$\mu$ was added to 1 l of a developer for lithographic films containing the bromide ion at concentration of 1.0235 M, and the mixture was agitated at room temperature for 5 hours. During this agitation treatment, a fixed small amount of the supernatant was sampled at every predetermined interval and the bromide ion concentration in the sampled solution was determined to obtain results shown in Table 2, from which it is seen that the bromide ion concentration in the solution was gradually decreased. The values of the bromide ion adsorption ratio given in the Table are those calculated in the same manner as described in Example 1.

Table 2

| Time after Addition of Bismuth Oxide | Bromide Ion Concentration (M) in Developer | Bromide Ion Adsorption Ratio (%) |
|---|---|---|
| 15 minutes | 0.0228 | 3 |
| 30 minutes | 0.0215 | 8 |
| 1 hour | 0.0204 | 13 |
| 2 hours | 0.0178 | 24 |
| 3 hours | 0.0157 | 33 |
| 4 hours | 0.0148 | 37 |
| 5 hours | 0.0145 | 38 |

The bismuth trioxide was separated from the above developer and added to 300 cc of a 1 N aqueous solution of sodium hydroxide. The mixture was agitated at room temperature for 5 hours, and the bismuth trioxide was recovered by filtration and washed with water, whereby the bromide ion-adsorbing activity was restored completely.

EXAMPLE 3

10 l of a developer for lithographic films, the composition of which had been changed by the use for the developmemt treatment, was circulated in a column packed with 400 g of bismuth trioxide having an average particle size of 10$\mu$ at room temperature for 3 hours by means of a pump to thereby contact the used liquid developer with bismuth oxide. It was found that among the components contained in the used developer, only the bromide ion was selectively adsorbed and the concentration of the bromide ion alone was extremely reduced. Results are shown in Table 3.

Table 3

| Component | Concentration before Treatment | Concentration after Treatment | Adsorption Ratio (%) | Desired Concentration |
|---|---|---|---|---|
| sodium hydroxymetasulfonate | 50.5 | 50.0 | 1.0 | 53.0 |
| sodium sulfite | 2.0 | 2.0 | 0 | 2.0 |
| hydroquinone | 13.8 | 13.8 | 0 | 16.0 |
| potassium bromide | 3.75 | 2.75 | 26.6 | 2.80 |
| sodium carbonate | 82.5 | 81.7 | 1.0 | 85.0 |
| boric acid | 8.0 | 8.0 | 0 | 8.0 |
| sodium chloride | 1.10 | 0.91 | 17.3 | 0 |

In the Table, the concentration before treatment means the concentration of each component of the used developer, and the concentration after treatment means the concentration of each component in the liquid developer after it had been treated according to the method of this invention. The desired concentration means the optimum concentration of each component for the developer to exhibit a maximum developing activity, and a fresh developer contains each component at a concentration adjusted to this desired concentration.

In the Table, each concentration value is expressed based on the unit of g/l. The absorption ratio of each component was calculated in the same manner as described in Example 1. Each of these items has the same meaning as above in Tables given in subsequent Examples. As is seen from the results shown in Table 3, only the bromide ion having a bad influence on the developing activity could be selectively removed from the exhausted developer and the bromide ion concentration could be adjusted to the level suitable for the development processing. When a fresh developing chemical was added in an amount compensating the loss by the development treatment, to the developer in which the bromide ion concentration was thus adjusted, the developing activity of the developer could be easily restored and it could be used for the development treatment again.

After the circulation of the exhausted developer, about 3 l of a 1 N aqueous solution of sodium hydroxide was circulated through the column packed with bismuth oxide at room temperature for 3 hours by means of a pump, and then a great quantity of water was passed through the column to wash the bismuth trioxide, whereby the bromide ion-adsorbing activity of the bismuth oxide was restored substantially completely.

EXAMPLE 4

10 l of used and exhausted developer for Roentgen films for clinical use was circulated through a column packed with 800 g of bismuth trioxide monohydrate having an average partical size of 20$\mu$ at room temperature for 3 hours by means of a pump to thereby contact the developer with bismuth trioxide. As a result only the bromide ion concentration in the developer could be reduced extremely and the bromide ion concentration was adjusted to a desired level.

Results are shown in Table 4.

Table 4

| | Component | Concentration before Treatment | Concentration after Treatment | Adsorption Ratio (%) | Desired Concentration |
|---|---|---|---|---|---|
| phenidon | phenidone | 0.32 | 0.32 | 0 | 0.35 |
| | hydroquinone | 6.8 | 6.8 | 0 | 9.0 |
| | sodium sulfite | 67.5 | 67.3 | 0.3 | 70.0 |
| | sodium carbonate monohydrate | 32.4 | 31.8 | 1.9 | 35.0 |
| | potassium bromide | 8.70 | 4.10 | 52.9 | 4.00 |

After the circulation of the exhausted developer, the bismuth oxide in the column was taken out of the column and added to 5 l of a 1.5 N aqueous solution of sodium hydroxide, and the mixture was agitated at 60° C for 2 hours. Then, the bismuth oxide was recovered by filtration and washed with water. Thus, the bromide ion-adsorbing activity of the bismuth oxide was restored completely.

EXAMPLE 5

10 l of a used and exhausted developer for negative film for color photography, the composition of which had been changed by the development treatment was circulated through a column packed with 800 g of bismuth hydroxide having an average particle size of 20$\mu$ for 2 hours by means of pump. Only the bromide ion concentration was reduced extremely, and a desired bromide ion concentration was attained in the so treated developer.

Results are shown in Table 5.

Table 5

| Component | Concentration before Treatment | Concentration after Treatment | Adsorption Ratio (%) | Desired Concentration |
|---|---|---|---|---|
| benzyl alcohol | 3.0 | 3.0 | 0 | 3.5 |
| sodium metaphosphate | 1.8 | 1.8 | 0 | 2.0 |
| sodium sulfite | 1.5 | 1.5 | 0 | 2.0 |
| sodium corbonate monohydrate | 48.1 | 47.8 | 0.6 | 50.0 |
| potassium bromide | 3.50 | 1.05 | 70 | 1.00 |
| coloring developing chemical | 2.0 | 2.0 | 0 | 5.0 |

In the Table, by "coloring developing chemical" is meant 4-amino-methyl-N-ethyl-N-($\beta$-methylsulfoneamide ethyl) aniline.

EXAMPLE 6

1 m$^2$ of a colored and developed printing paper for photography was bleached and fixed with use of 1 l of a bleach-fix solution containing 50 g/l of an ethylenediamine tetraacetate-ion (III) complex and 100 g/l of ammonium thiosulfate, the pH of which was maintained at 6.0 by boric acid and borax. As a result, the concentration of the bromide ion in the solution was increased by an amount corresponding to 4 g of ammonium bromide. The resulting solution was circulated through a column packed with 25 g of bismuth hydroxide dihydrate having an average particle size of 15$\mu$ for 2 hours by means of a pump to thereby contact the fix solution with bismuth hydroxide. As a result, the bromide ion in the solution was removed substantially completely.

EXAMPLE 7

The fixing treatment was conducted with use of a fix solution for monochromatic film comprising sodium thiosulfate as the main component, the pH of which was adjusted to 5.0 by boric acid and sodium acetate, and when the bromide ion concentration was increased to 0.1 M, bismuth trioxide was added to this solution in an amount of 25 g per liter of the solution. Then, the mixture was agitated for 3 hours, and the bromide ion concentration in the filtrate was determined. As a result, it was found that the bromide ion in the liquid was eliminated substantially completely.

We claim:

1. A method for adjusting the bromide ion concentration in a photographic processing solution selected from a developer, a bleach-fixing solution and a fixing solution, which comprises:

contacting said processing solution with particles consisting essentially of an insoluble bismuth compound selected from the group consisting of bismuth trioxide, bismuth tetroxide, and bismuth pentoxide so that said particles adsorb an excess bromide ion in said processing solution;

separating said particles from said processing solution;

and removing the adsorbed bromide ion from the separated particles whereby said particles are made reusable for repeating said contacting step in order to adjust the bromide ion concentration.

2. A method according to claim 1 wherein said particles are added to said processing solution.

3. A method for adjusting the bromide ion concentration in a photographic processing solution selected from a developer, a bleach-fixing solution and a fixing solution, which comprises:

contacting said processing solution with particles consisting essentially of an insoluble bismuth compound selected from the group consisting of bismuth trioxide, bismuth tetroxide, bismuth pentoxide and bismuth hydroxide so that said particles adsorb an excess bromide ion in said processing solution:

separating said particles from said processing solution:

and removing the adsorbed bromide ion from the separated particles by contacting said separate particles with an alkaline liquid and whereby said particles are made reusable for repeating said contacting step in order to adjust the bromide ion concentration.

4. A method according to claim 3 wherein the pH of said alkaline liquid is higher than that of said processing solution.

5. A method according to claim 3 wherein the pH of said alkaline liquid is greater than 10.

6. A method according to claim 3 wherein said alkaline liquid is aqueous.

7. A method according to claim 3 wherein said alkaline liquid is aqueous sodium hydroxide.

* * * * *